US005765253A

United States Patent [19]

Martinez

[11] Patent Number: 5,765,253

[45] Date of Patent: Jun. 16, 1998

[54] HAIR BRUSH WITH REPLACEABLE SECOND HANDLE

[76] Inventor: Rita L. Martinez, 3509 Cerena Ct., Aurora, Ill. 60504

[21] Appl. No.: 553,847

[22] Filed: Nov. 6, 1995

[51] Int. Cl.[6] ..... A46B 15/00

[52] U.S. Cl. ..... 15/160; 15/159.1; 15/143.1; 15/144.1; 15/145

[58] Field of Search ..... 15/27, 143.1, 144.1, 15/145, 159.1, 160, 144.3; 132/120

[56] References Cited

U.S. PATENT DOCUMENTS

| | | | |
|---|---|---|---|
| 622,621 | 4/1899 | Ham | 15/145 |
| 2,113,206 | 4/1938 | Yakimchick | 15/144.1 |
| 3,135,001 | 6/1964 | Levite | 15/144.1 |
| 3,843,990 | 10/1974 | Lardenois | 15/159.1 |
| 4,076,032 | 2/1978 | Misercola . | |
| 5,318,052 | 6/1994 | Ivanov | 132/237 |

FOREIGN PATENT DOCUMENTS

| | | | |
|---|---|---|---|
| 813151 | 9/1951 | Germany | 15/145 |
| 283372 | 9/1952 | Switzerland | 15/145 |
| 12202 | 5/1910 | United Kingdom | 15/145 |

*Primary Examiner*—Mark Spisich
*Attorney, Agent, or Firm*—Welsh & Katz, Ltd.

[57] ABSTRACT

An improved hair brush which can be selectively manipulated from either end when in contact with hair on a body is provided which has an elongated member or shaft with a handle extending from one end of the shaft, a short end portion extending from the shaft in the opposite direction, and a sleeve adapted to cover the handle and be releasably retained thereon. The sleeve and the short end portion are adapted to releasably secure the sleeve to the short end portion when the sleeve is released and removed from the handle. In such position, the sleeve can function as a second handle upon being releasably secured to the end portion, and the brush therefore can be manipulated by manipulating the handle or alternatively by manipulating the sleeve upon the sleeve being released from the handle and being secured to the end portion.

16 Claims, 1 Drawing Sheet

HAIR BRUSH WITH REPLACEABLE SECOND HANDLE

BACKGROUND OF THE INVENTION

1. Field of the Invention

This invention relates to hair brushes, and more particularly to brushes used for curling and styling hair, particularly where strands of hair are curled about the brush and an air stream from a hand-held blow dryer is directed to the strands of hair curled about the brush.

2. Description of Related Art

Hair brushes for curling and styling hair which have a cylindrical brush portion with bristles or tufts of bristles extending radially outwardly from a central shaft and a handle extending from one end of the shaft are well known to the art. An example of such a brush in which the bristles extend from a deformable sleeve member surrounding the shaft is shown in U.S. Pat. No. 3,843,990.

Another brush of this type, but without the deformable sleeve member, and instead with a hollow, open-ended shaft having air slots, is shown in U.S. Pat. No. 4,076,032. This patent teaches that the brush may be used with a blow dryer for hair styling wherein air from the dryer directed to the brush can enter the slots, pass through the hollow shaft and exit its open end.

It is also common to use a plurality of short handleless brushes or rollers to curl and set the hair, and, optionally, to apply a stream of heated air from a hair dryer. U.S. Pat. No. 5,318,052, generally illustrates rollers or brushes of this type, but each having a holding member at one end to which a replaceable handle may be attached.

The known brush and roller devices are not fully satisfactory for styling and curling the hair with a hand-held hair dryer. For example, upon using a handled brush or a roller with a handle attached to wrap strands of hair about the brush portion, when it is desired to blow dry the wrapped strands about the brush portion in styling or curling, the user, particularly in a self-styling of the hair, but perhaps also a hair stylist or barber styling a client's hair, frequently is required to switch hands to operate the dryer with his or her dominant or stronger hand. As an example of the latter, a right-handed user will prefer to use his or her right or stronger hand to hold the dryer, and if the user is styling or curling his or her own hair, it may be necessary to twist the hand holding the dryer over or around the head to direct the stream of air toward the strands wrapped about the brush portion of the hair brush. While a brush with handles extending from both ends might eliminate the necessity of twisting the arm to simultaneously hold the handle of the brush and hold the dryer with the stronger hand by switching hands between the brush and the dryer, a brush with handles extending from both ends is awkward to use during the styling or curling of hair strands about the brush portion of the brush as the handle not being grasped will frequently interfere with the styling or curling operation.

SUMMARY OF THE INVENTION

Hence, it is one object of the present invention to provide a hair brush with a permanent handle and with a replaceable handle on its end opposite the permanent handle.

It is another object of the present invention to provide a hair brush which resembles a common hair brush with a brush portion and a handle portion, and which provides for storage of a second, replaceable handle during use and while being stored between uses.

It is still another object of this invention to provide a hair brush which facilitates the curling of hair during styling using the handle of the brush, and facilitates the convenient handling of the brush with the opposite hand during the use of a hand-held dryer with the stronger hand during the drying steps of the styling or curling operation.

These and other objects and advantages of the present invention will be apparent from the following description.

In accordance with the present invention, an improved hair brush is provided with a handle at one end for ease of styling or curling the hair, and which can be selectively manipulated from either end when in contact with hair on a body. The improved hair brush includes an elongated member or shaft, a plurality of bristles or tufts of bristles extending directly or indirectly from the shaft, a handle extending from a first end of the shaft, and, additionally, a sleeve adapted to cover the handle which is removable from the handle and is attachable to the other end of the shaft to be manipulated as a second handle as will be hereinafter described.

More particularly, in its simplest form, the bristles or tufts of bristles of the brush extend generally transversely with respect to the direction of elongation of the shaft along at least a portion of the length of the shaft. The sleeve, which preferably encloses and covers the handle for storage and to keep it out of the way while the brush is being used to curl hair strands about the bristles or tufts of bristles, is desirably releasably retained on the handle. The sleeve is readily attachable to the end of the shaft opposite to the end from which the handle extends (hereafter referred to as the second end of the shaft), so as to function as a second handle, by having the shaft define at the second end a short end portion extending beyond the plurality of the bristles to which the sleeve can be releasably secured when the sleeve is released and removed from the handle. In this manner, the sleeve can function as a handle upon being releasably secured on the short end portion, whereby the brush can be manipulated by manipulating the handle or alternatively by manipulating the sleeve upon the sleeve being released from the handle and being secured to the end portion.

In a preferred form, the hair brush of the invention, includes the sleeve having means for releasably retaining the sleeve on the handle and for releasably retaining the sleeve on the short end portion. The handle of the hair brush desirably also includes means for releasably retaining the sleeve on the handle. Further, in its preferred form, the short end portion of the hair brush of the invention includes means for releasably retaining the sleeve on the short end portion. Also preferably, the sleeve and the handle include cooperating means for releasably retaining the sleeve on the handle. Similarly, it is preferred to have the sleeve and the short end portion include cooperating means for releasably retaining the sleeve on the end portion. Most preferably, the sleeve, the handle and the short end portion include cooperating means for releasably retaining the sleeve on the handle and for releasably retaining the sleeve on the end portion.

The present invention will be more fully understood from the accompanying drawings which are to be read in conjunction with the description of the preferred embodiment, both showing and describing for illustration, a simple brush with the bristles or tufts of bristles extending from the elongated member or shaft, and the sleeve having relatively uncomplicated means for releasably securing the sleeve covering the handle to the handle and to the shaft. However, it should be understood that this invention is applicable to other configurations of hair brushes, for example, a hair brush where the bristles are supported on a sleeve spaced from the shaft or where the shaft is hollow and pierced with slots to allow air to flow through the brush.

DESCRIPTION OF THE PREFERRED EMBODIMENT

Figure 3:
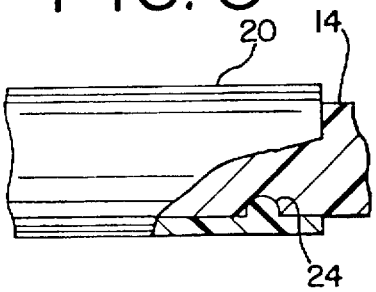
FIG. 3 is an enlarged, partially cross-sectional, fragmentary view illustrating a sleeve releasably secured to a handle in accordance with the present invention.
Figure 2:
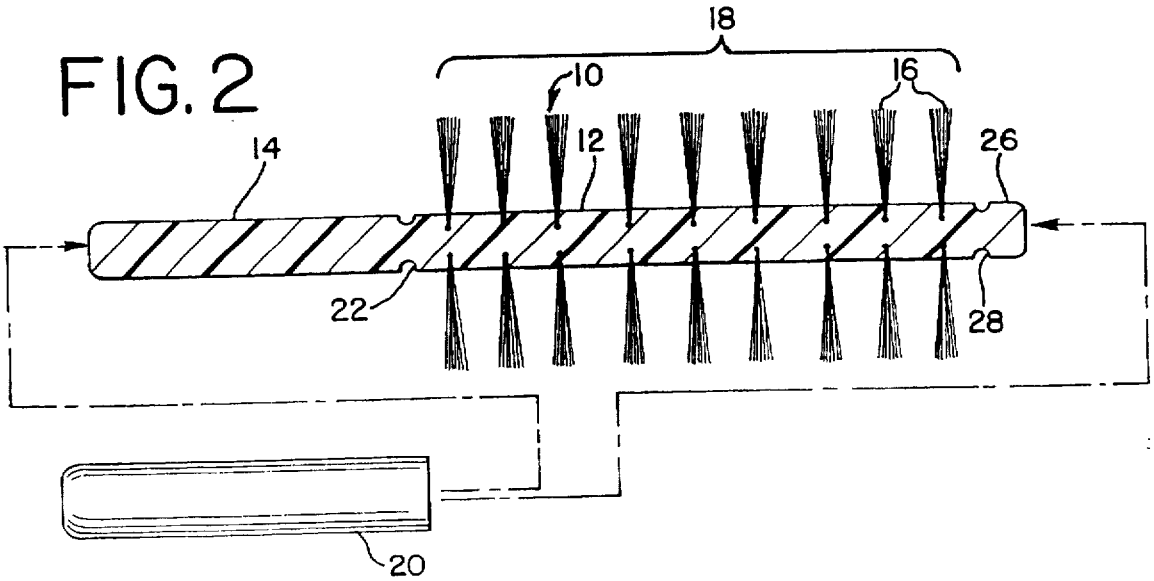
FIG. 2 is a partially cross-sectional, exploded view of a hair brush in accordance with the present invention showing the sleeve being releasably attachable to the handle or to the short end portion of the shaft.

In the preferred embodiment of the present invention, best shown in FIGS. 2 and 3, an improved hair brush in accordance with this invention is designated generally by the numeral 10. Brush 10 includes an elongated member or shaft 12, which desirably can be made of wood or plastic (as shown), or of other material, and has a handle 14 extending from one end, which, as shown, is preferably integral with shaft 12. A plurality of bristles 16, in the form of tufts of bristles, (referred to as bristles 16 for simplicity), extend radially outward from, and generally transversely with respect to the direction of elongation of shaft 12 at least along a portion 18 of the shaft. Bristles 16 can be placed in openings in shaft 12, as is known to the art.

Brush 10 further includes a sleeve 20 which is closed at one end and is releasably retained on handle 14 by detent means cooperating with at least one recess formed on the surface of handle 14. Preferably, the at least one recess formed in the surface of the handle is an annular recess 22, and the detent means is an annular detent 24 formed on the inner surface of sleeve 20 and spaced from the ends of sleeve 20 so as to closely and substantially cover handle 14 when placed and retained on handle 14 in any rotational orientation on the handle.

Shaft 12 has an end portion 26 which is shorter than handle 14, and extends beyond portion 18 in the direction opposite to the direction handle 14 extends from portion 18. End portion 26 of shaft 12 is adapted to releasably secure sleeve 20 thereon by having at least one recess on the surface of end portion 26 adapted to cooperate with the detent means on sleeve 20. In the preferred embodiment shown, the at least one recess on the surface of end portion 26 is an annular recess 28 substantially similar to recess 22 in handle 14, and is formed to cooperate with annular detent 24 to releasably retain and secure sleeve 20 on end portion 26 when sleeve 20 is removed from and not being retained on handle 14. Upon sleeve 20 being retained on end portion 26, sleeve 20 can serve as a second handle of brush 10.

In the preferred embodiment, handle 14 has at least one cylindrical portion in which annular recess 22 is formed, short end portion 26 similarly has at least one cylindrical portion in which annular recess 28 is formed, and detent 24 cooperates selectively and alternatively with recess 22 and recess 28 to support and releasably retain sleeve 20 on either handle 14 or end portion 26 where sleeve 20 functions as a second handle, as desired.

Figure 1:
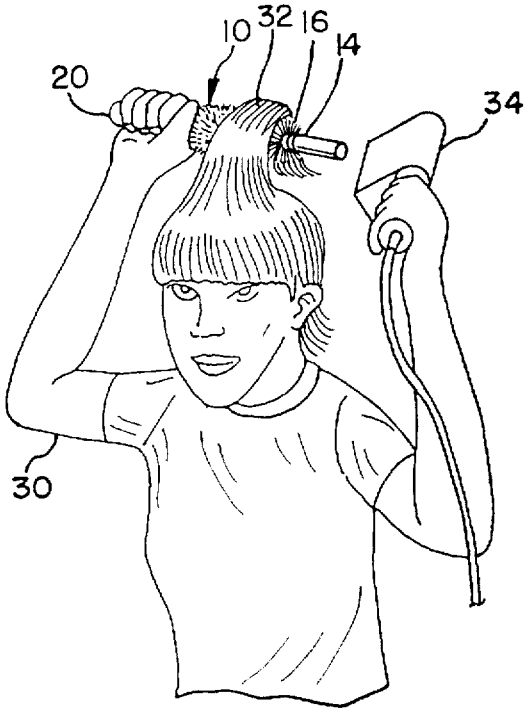
FIG. 1 is an illustration of a person using a hair brush in accordance with the present invention during a hair drying step.

As previously noted, when sleeve 20 is secured on handle 14, it encloses and covers the handle and is readily stored on the handle so it is out of the way while brush 10 is being used during the initial steps of styling and curling the hair. For example, a left-handed user 30 may find it most comfortable to manipulate the handle 14 covered by sleeve 20 of brush 10 to curl stands of hair 32 about the plurality of bristles 16 of brush 10 with the user's left hand, as shown in FIG. 1. When the user desires to perform other steps of the styling or curling procedure, for example, to use a hand-held blow dryer 34 to direct a stream of heated air toward the strands of hair 32 curled about bristles 16 of the brush, it is not necessary that user 30 hold the dryer in the right hand. Rather, the left-handed user 30 may find it preferable, for example, less tiring, to hold and support the dryer in the left hand. This can be done in accordance with the present invention without twisting the user's other hand about the head and brush to grasp and hold the brush by handle 14. To accomplish the latter, user 30 can remove sleeve 20 from handle 14 by pulling sleeve 20 off of handle 14, thereby removing detent 24 from recess 22, and can then place the open end of sleeve 20 onto the end of end portion 26, and push sleeve 20 onto end portion 26 causing detent 24 of sleeve 20 to enter and be secured into recess 28. The user 30 can then grasp sleeve 20 with the right hand, while holding, supporting and manipulating dryer 34 with the left hand.

In this manner, hair brush 10 of the preferred embodiment can be comfortably utilized in styling and curling the hair, without the user uncomfortably twisting the hands and arms in order to hold, first the brush, and then a hand-held blow dryer in the preferred or stronger hand. The brush of the present invention is advantageously used in self styling of a person's hair, because that person need not twist the arm holding the brush about or around the head after the stronger hand is used to curl hair strands about the bristles of the brush, in order to use that stronger hand to hold and manipulate a hand-held blow dryer.

While a particular embodiment of a brush structure in accordance with the invention has been shown and described, it will be appreciated by those skilled in the art that changes and modifications may be made thereto without departing from the invention in its broader aspects and as set forth in the following claims.

What is claimed is:

1. A hair brush which can be selectively manipulated from either end when in contact with hair on a body, comprising:

an elongated member;

a plurality of bristles or tufts of bristles associated with and extending generally transversely with respect to the direction of elongation of said elongated member along at least a portion of the length of said member;

a handle integral with and extending from a first end of said elongated member;

a sleeve adapted to cover said handle and be releasably retained thereon;

said elongated member defining a short end portion extending in the direction of elongation from a second end thereof opposite the first end, said end portion extending beyond the plurality of said bristles, and said end portion being adapted to releasably secure said sleeve to said elongated member when said sleeve is released and removed from said handle, said sleeve being functionable as a handle upon being releasably secured on said end portion, whereby said brush can be manipulated by manipulating the handle or alternatively by manipulating the sleeve upon the sleeve being released from the handle and being secured to the end portion.

2. A hair brush as claimed in claim 1, wherein said sleeve includes means for releasably retaining said sleeve on said handle and for releasably retaining said sleeve on said end portion.

3. A hair brush as claimed in claim 1, wherein said handle includes means for releasably retaining said sleeve on said handle.

4. A hair brush as claimed in claim 1, wherein said end portion includes means for releasably retaining said sleeve on said end portion.

5. A hair brush as claimed in claim 1, wherein said sleeve and said handle include cooperating means for releasably retaining said sleeve on said handle.

6. A hair brush as claimed in claim 1, wherein said sleeve and said end portion include cooperating means for releasably retaining said sleeve on said end portion.

7. A hair brush as claimed in claim 1, wherein said sleeve, said handle and said end portion include cooperating means for releasably retaining said sleeve on said handle and for releasably retaining said sleeve on said end portion.

8. A hair brush which can be selectively manipulated from either end when in contact with hair on a body, comprising:

an elongated member;

a plurality of bristles or tufts of bristles associated with and extending generally transversely with respect to the direction of elongation of said elongated member along at least a portion of the length of said member;

a handle integral with and extending from a first end of said elongated member;

a sleeve adapted to cover said handle;

said elongated member defining an end portion extending in the direction of elongation from a second end thereof opposite the first end, said end portion extending beyond the plurality of said bristles; and said sleeve having means for selectively releasably retaining said sleeve on said handle and for selectively releasably retaining said sleeve on said end portion when said sleeve is released and removed from said handle, said sleeve being functionable as a handle upon being releasably secured on said end portion, whereby said brush can be manipulated by manipulating the handle or alternatively by manipulating the sleeve upon the sleeve being released from the handle and being secured to the end portion.

9. A hair brush as claimed in claim 8, wherein said handle includes means for cooperating with said means for releasably retaining said sleeve on said handle.

10. A hair brush as claimed in claim 8, wherein said end portion includes means for cooperating with said means for releasably securing said sleeve to said end portion of said elongated member.

11. A hair brush which can be selectively manipulated from either end when in contact with hair on a body, comprising:

an elongated member;

a plurality of bristles or tufts of bristles associated with and extending generally transversely with respect to the direction of elongation of said elongated member along at least a portion of the length of said member;

a handle integral with and extending from a first end of said elongated member, said handle having at least one recess in the surface thereof;

a sleeve adapted to cover said handle;

said elongated member defining a end portion extending in the direction of elongation from a second end thereof opposite the first end, said end portion extending beyond the plurality of said bristles, and having at least one recess in the surface thereof; and said sleeve having detent means for selectively engaging with the at least one recess in said handle for releasably retaining said sleeve on said handle, and for selectively engaging with the at least recess in said end portion for releasably retaining said sleeve on said end portion when said sleeve is released and removed from said handle, said sleeve being functionable as a handle upon being releasably secured on said end portion, whereby said brush can be manipulated by manipulating the handle or alternatively by manipulating the sleeve upon the sleeve being released from the handle and being secured to the end portion.

12. A hair brush as claimed in claim 11, wherein said at least one recess in said handle is an annular recess in the surface of said handle.

13. A hair brush as claimed in claim 12, wherein said handle has at least one cylindrical portion, and said at least one recess in said handle is an annular recess in the surface of the at least one cylindrical portion of said handle.

14. A hair brush as claimed in claim 11, wherein said at least one recess in said end portion is an annular recess in the surface of said end portion.

15. A hair brush as claimed in claim 14, wherein said end portion of said elongated member has at least one cylindrical portion, and said at least one recess in said end portion is an annular recess in the surface of the at least one cylindrical portion of said end portion.

16. A hair brush as claimed in claim 11, wherein said said handle has at least one cylindrical portion, and said at least one recess in said handle is an annular recess in the surface of the at least one cylindrical portion of said handle, wherein said end portion of said elongated member has at least one cylindrical portion, and said at least one recess in said end portion is an annular recess in the surface of the at least one cylindrical portion of said end portion, and wherein said detent means is a detent adapted to selectively engage said annular recess in the surface of the at least one cylindrical portion of said handle and the annular recess in the surface of the at least one cylindrical portion of said end portion.

* * * * *